United States Patent [19]

Miskinis et al.

[11] Patent Number: 4,764,445

[45] Date of Patent: Aug. 16, 1988

[54] ELECTROGRAPHIC MAGNETIC CARRIER PARTICLES

[75] Inventors: Edward T. Miskinis; Bijay S. Saha, both of Rochester, N.Y.

[73] Assignee: Eastman Kodak Company, Rochester, N.Y.

[21] Appl. No.: 62,023

[22] Filed: Jun. 15, 1987

[51] Int. Cl.[4] ..... G03G 9/14

[52] U.S. Cl. ..... 430/108; 252/62.57; 252/521

[58] Field of Search ..... 252/521, 62.57; 430/108

[56] References Cited

U.S. PATENT DOCUMENTS

| | | | |
|---|---|---|---|
| 2,900,344 | 8/1959 | Stuyts | 252/62.57 |
| 2,982,607 | 5/1961 | Moruzzi | 252/62.57 X |
| 3,193,502 | 7/1965 | Schieber | 252/62.57 |
| 3,839,029 | 10/1974 | Berg et al. | 96/1 SD |
| 3,914,181 | 10/1975 | Berg et al. | 252/62.1 |
| 3,929,657 | 12/1975 | Jones | 252/62.1 P |
| 4,042,518 | 8/1977 | Jones | 252/62.6 |
| 4,473,029 | 9/1984 | Fritz et al. | 118/657 |
| 4,540,645 | 9/1985 | Honda et al. | 430/122 |
| 4,546,060 | 10/1985 | Miskinis et al. | 430/108 |
| 4,623,603 | 11/1986 | Iimura et al. | 430/108 |

OTHER PUBLICATIONS

Chemical abstracts vol. 101/64800x, 80/75917q, 80/31933u.

*Primary Examiner*—J. David Welsh

*Attorney, Agent, or Firm*—Richard D. Fuerle

[57] ABSTRACT

Hard ferrite magnetic carrier particles for use in two component developers together with toner particles for the development of electrostatic latent image patterns and containing from about 1 to about 5 percent by weight of lanthanum exhibit improved development efficiency.

24 Claims, No Drawings

ELECTROGRAPHIC MAGNETIC CARRIER PARTICLES

BACKGROUND OF THE INVENTION

This invention relates to electrography and more particularly it relates to magnetic carrier particles and developers for the dry development of electrostatic charge images.

In electrography, an electrostatic charge image is formed on a dielectric surface, typically the surface of the photoconductive recording element. Development of this image is commonly achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is known in the art to apply developer compositions of the above type to electrostatic images by means of a magnetic applicator which comprises a cylindrical sleeve of non-magnetic material having a magnetic core positioned within. The core usually comprises a plurality of parallel magnetic strips which are arranged around the core surface to present alternative north and south magnetic fields. These fields project radially, through the sleeve, and serve to attract the developer composition to the sleeve outer surface to form a brushed nap. Either or both the cylindrical sleeve and the magnetic core are rotated with respect to each other to cause the developer to advance from a supply sump to a position in which it contacts the elecrostatic image to be developed. After development the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060 and 4,473,029 teach the use of hard magnetic materials as carrier particles and an apparatus for the development of electrostatic images utilizing such hard magnetic carrier particles, respectively. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of *Introduction To Magnetic Materials* by B. D. Cullity published by Addison-Wesley Publishing Company, 1972. These hard magnetic carrier materials represent a great advance over the use of soft magnetic carrier materials in that the speed of development is remarkably increased without experiencing deterioration of the image. Speeds as high as four times the maximum speed utilized in the use of soft magnetic carrier particles have been demonstrated.

The above two mentioned U.S. patents, while generic to all hard magnetic materials having the properties set forth, prefer the hard magnetic ferrites which are compounds of barium and/or strontium such as, $BaFe_{12}O_{19}$, $SrFe_{12}O_{19}$ and the magnetic ferrites having the formula $MO.6Fe_2O_3$, where M is barium, strontium or lead as disclosed in U.S. Pat. No. 3,716,630. While these hard ferrite carrier materials represent a substantial increase in the speed with which development can be conducted in an electrostatographic apparatus, it is desired that even further improvements in this regard be made.

SUMMARY OF THE INVENTION

The present invention provides carrier particles for use in the development of electrostatic images wherein the carrier particles comprise a hard magnetic ferrite material having a hexagonal crystal structure, exhibiting a coercivity of at least 300 Oersteds when magnetically saturated and an induced magnetic moment of at least 20 EMU/gm when in an applied field of 1000 Oersteds and containing from about 1 to about 5 percent by weight of lanthanum.

The invention also contemplates an electrographic developer suitable for extremely high speed copying applications without the loss of copy image quality including charged toner particles and oppositely charged carrier particles as described above. The method of developing electrostatic images on a surface is also contemplated utilizing a two-component developer.

DETAILED DESCRIPTION OF THE INVENTION

As pointed out above in connection with U.S. Pat. Nos. 4,546,060 and 4,473,029 the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO.6Fe_2O_3$ wherein M is barium, strontium or lead. These materials have a hexagonal structure. (The disclosures of these two patents are incorporated herein by reference.) While the speed with which development can be carried out is much higher than the heretofore techniques employed, they are limited by the resistivity of the above described ferrite materials which have the necessary magnetic properties for carrying out the development method. For example, the resistivity of strontium ferrite having the formula $SrO.6Fe_2O_3$ is approximately $10^9$ ohm.cm. It is generally known that the resistivity of the carrier particles bears a direct result on the speed of development that can be employed.

While development speed is generally referred to in the prior art, a more meaningful term is to speak of "development efficiency". In a magnetic brush development system, development efficiency is defined as the potential difference between the photoreceptor in developed image areas before and after development divided by the potential difference between the photoreceptor and the brush prior to development times 100. Thus, for example, if the photoreceptor film voltage is −250 volts and the magnetic brush is −50 volts the potential difference is −200 volts prior to development. If, during development, the film voltage is reduced by 100 volts to −150 volts in image areas by the deposition of positively charged toner particles, the development efficiency is $(-100 \text{ volts} \div -200 \text{ volts}) \times 100$, which gives an efficiency of development of 50 percent. It can be readily seen that as the efficiency of the developer material increases the various parameters employed in the electrostatographic method can be altered in accordance therewith. For example, as the efficiency increases the voltage differential prior to development can be reduced in order to deposit the same amount of toner in image areas as was previously done at the lower efficiency. The same is true with regard to the exposure energy level employed to impart the latent electrostatic image on the photoreceptor film. The speed of the development step of the procedure can be increased as the efficiency increases in that as the efficiency increases more toner can be deposited under the same conditions in a shorter period of time. Thus, higher development efficiency permits the reoptimization of the various parameters employed in the electrostatic process thereby resulting in savings in both energy and time.

The efficiency of development when employing the ferrite carriers of the prior art is limited by the resistivity of the ferrite materials themselves. For example, because these materials have a resistivity of approximately $10^9$ ohm.cm the highest efficiency is approximately 50 percent. However, in order to obtain high quality copies of the original image, it is necessary to maintain the high magnetic properties; i.e. a coercivity of at least 300 Oersteds when magnetically saturated and an induced magnetic moment of at least 20 EMU/gm when in an applied field of 1000 Oersteds while at the same time increasing the conductivity of the particles.

The invention contemplates the incorporation of an effective amount of lanthanum into the crystalline lattice of a hard magnetic ferrite material having a hexagonal crystal structure to reduce the resistivity of the material while maintaining the magnetic properties. Thus, the resistivity of hard hexagonal ferrite materials can be reduced from approximately $10^9$ to approximately $10^2$ ohm.cm without effecting the high magnetic properties of the material. While it is not the intent to be bound by any theory or mechanism by which the resistivity of these ferrite materials are decreased, it is believed that the lanthanum replaces the barium, strontium or lead in the ferrite structure when introduced in amounts of from 1 to about 5 percent by weight. Since lanthanum exists in the +3 oxidation state and these other materials (Ba, Sr and Pb) in the +2 oxidation state the substitution of lanthanum causes the iron to revert from the +3 state to the +2 oxidation state to thereby maintain charge neutrality in the ferrite crystal. Therefore, by adjusting the amount of lanthanum that is substituted into the ferrite crystal the amount of iron in the +2 state can be controlled and therefore the resistivity of the material is in turn adjusted. It is preferred that the amount of lanthanum substituted into the crystalline lattice of the ferrite be limited such that only a single phase hexagonal crystalline structure is obtained. While the quantity of lanthanum will vary somewhat depending upon the sintering conditions utilized in the preparation of the ferrite particles, it has been found that the amount of lanthanum can vary from about 1 to about 5 percent by weight of the ferrite material and still maintain the high magnetic properties needed to prevent throw-off of the developer from the magnetic brush developer. As the quantity of lanthanum exceeds this amount a second phase, believed to be $LaFeO_3$ having an orthorhombic structure is formed. While the continued increase in the amount of lanthanum reduces the resistivity significantly the formation of the orthorhombic structure causes a dramatic decrease in the magnetic properties of the ferrites which thereby creates image quality problems. In addition the decrease in magnetic force is responsible for an increase in throw-off from the magnetic brush.

The preparation of ferrites generally and hard hexagonal ferrites (Ba, Sr or Pb) particularly are well documented in the literature. Any suitable method of making the ferrite particles may be employed such as disclosed in U.S. Pat. Nos. 3,716,630, 4,623,603 and 4,042,518; European Patent Application No. 0 086 445; "Spray Drying" by K. Masters published by Leonard Hill Books London, pages 502–509 and "Ferromagnetic Materials", Volume 3 edited by E. P. Wohlfarth and published by North-Holland Publishing Company, Amsterdam, New York, Oxford, pages 315 et seq. The ferrites containing from about 1 to about 5 percent by weight of lanthanum in accordance with this invention are prepared in a similar manner as described above by adding lanthanum oxide to the formulation. For example, if the ferrite to be prepared is strontium ferrite containing from about 1 to about 5 percent by weight of lanthanum, about 8 to 12 parts strontium carbonate, about 1 to 5 parts lanthanum oxide and 85 to 90 parts of iron oxide are mixed with a dispersant polymer gum arabic and water as a solvent. The solvent is removed by spray drying and the resultant beads are fired at about 1200° C. to form the ferrite $La_xSr_{1-x}Fe_{12}O_{19}$ where x has a value of from about 0.1 to about 0.4. The ferrite is ball milled to reduce the particle size to that generally required of carrier particles, that is, less than 100 μm and preferably from about 5 to 65 μm, and then permanently magnetized by subjecting it to an applied magnetic field of sufficient strength to magnetically saturate the particles.

The present invention comprise two types of carriers particles. The first of these carriers comprises a binder-free magnetic particulate material exhibiting the requisite coercivity and induced magnetic moment. This type is preferred.

The second is heterogeneous and comprises a composite of a binder and a magnetic material exhibiting the requisite coercivity and induced magnetic moment. The magnetic material is dispersed as discrete smaller particles throughout the binder; however, the resistivity of these binder type polymers must be comparable to the binderless particles in order for the above stated advantages to be observed. It may be desirable to add conductive carbon black to the binder to insure electrical contact between the ferrite particles.

The individual bits of the magnetic material should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magentic component to carrier can be used. Excellent results are obtained with magnetic powders of the order of 5 micrometers down to 0.05 micrometer average diameter. Even finer powders can be used when the degree of subdivision does not produce unwanted modifications in the magnetic properties and the amount and character of the selected binder produce satisfactory strength, together with other desirable mechanical and electrical properties in the resulting carrier particle.

The concentration of the magnetic material can vary widely. Proportions of finely divided magnetic material, from about 20 percent by weight to about 90 percent by weight, of composite carrier can be used as long as the resistivity of the particles is that representative of the ferrite particles above.

The induced moment of composite carriers in a 1000 Oersteds applied field is dependent on the concentration of magnetic material in the particle. It will be appreciated, therefore, that the induced moment of the magnetic material should be sufficiently greater than 20 EMU/gm to compensate for the effect upon such induced moment from dilution of the magnetic material in the binder. For example, one might find that, for a concentration of 50 weight percent magnetic material in the composite particles, the 1000 Oersteds induced magnetic moment of the magnetic material should be at least 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) prefereably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, basic monomers such as vinyl pyridines, etc. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, etc., and in cutting or shearing to shape the carrier particles; grinding, e.g., in ball mill to reduce carrier material to appropriate particle size; and sifting operations to classify the particles.

According to one preparation technique, the powdered magnetic material is dispersed in a solution of the binder resin. The solvent may then be evaporated and the resulting solid mass subdivided by grinding and screening to produce carrier particles of appropriate size.

According to another technique, emulsion or suspension polymerization is used to produce uniform carrier particles of excellent smoothness and useful life.

The coercivity of a magnetic material refers to the minimum external magnetic force necessary to reduce the induced magnetic moment from the remanance value to zero while it is held stationary in the external field, and after the material has been magnetically saturated, i.e., the material has been permanently magnetized. A variety of apparatus and methods for the measurement of coercivity of the present carrier particles can be employed. For the present invention, a Princeton Applied Research Model 155 Vibrating Sample Magnetometer, available from Princeton Applied Research Co., Princeton, N.J., is used to measure the coercivity of powder particle samples. The powder was mixed with a nonmagnetic polymer powder (90 percent magnetic powder: 10 percent polymer by weight). The mixture was placed in a capillary tube, heated above the melting point of the polymer, and then allowed to cool to room temperature. The filled capillary tube was then placed in the sample holder of the magnetometer and a magnetic hysteresis loop of external field (in Oersteds) versus induced magnetism (in EMU/gm) was plotted. During this measurement, the sample was exposed to an external field of 0 to 8000 Oersteds.

The carrier particles may be coated in order to properly charge the toner particles of the developer. This can be done by forming a dry mixture of suitable ferrite with a small amount of powdered resin, e.g., 0.05 to 3.0 weight percent resin, and heating the mixture to fuse the resin. Such a low concentration of resin will form a thin or discontinuous layer of resin on the ferrite particles.

Since the presence of lanthanum in the ferrite is intended to improve conductivity of carrier particles, the layer of resin on the carrier particles should be thin enough that the mass of particles remains conductive. Preferably the resin layer is discontinuous; spots of bare ferrite on each particle provide conductive contact.

Various resin materials can be employed as a coating on the "hard" magnetic carrier particles. Examples include those described in U.S. Pat. Nos. 3,795,617 issued Mar. 5, 1974, to J. McCabe, 3,795,618 issued Mar. 5, 1974, to G. Kasper, and 4,076,857 to G. Kasper. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene).

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in *Colour Index*, Vols. I and II, 2nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground. The resulting toner particles range in diameter from 0.5 to 25 micrometers with an average size of 1 to 16 micrometers. Preferably, the average particle size ratio of carrier to toner lies within the range from about 15:1 to about 1:1. However, carrier-to-toner average particle size ratios of as high as 50:1 are also useful.

The toner resin can be selected from a wide variety of materials, including both natural and synthetic resins and modified natural resins, as disclosed, for example, in the patent to Kasper et al., U.S. Pat. No. 4,076,857 issued Feb. 28, 1978. Especially useful are the crosslinked polymers disclosed in the patent to Jadwin et al., U.S. Pat. No. 3,938,992 issued Feb. 17, 1976, and the patent to Sadamatsu et al., U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sept. 5, 1979, to J. Ugelstad.

The toner can also contain minor components such as charge control agents and antiblocking agents. Especially useful charge control agents are disclosed in U.S. Pat. No. 3,893,935 and British Pat. No. 1,501,065. Quaternary ammonium salt charge agents as disclosed in Research Disclosure, No. 21030, Volume 210, October, 1981 (published by Industrial Opportunities Ltd., Homewell, Havant, Hampshire, PO9 1EF, United Kingdom), are also useful.

In the method of the present invention, an electrostatic image is brought into contact with a magnetic brush comprising a rotating-magnetic core, an outer non-magnetic shell and the two-component, dry developer described above. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image can be employed, the combination of screening with development in accordance with the method for the present invention producing high-quality images exhibiting high Dmax and excellent tonal range. Representative screening methods including those employing photoreceptors with integral half-tone screens are disclosed in U.S. Pat. No. 4,385,823 issued May 31, 1984.

Developers including magnetic carrier particles in accordance with this invention when employed in an apparatus such as that described in U.S. Pat. No. 4,473,029 exhibit a dramatic increase in development efficiency when compared with a similar ferrite material not containing lanthanum when operated at the same voltage differential of the magnetic brush and photoconductive film. For example, when strontium ferrite carrier particles, similar in all respects except for the presence of lanthanum therein is compared with carrier particles containing 3.3 percent by weight of lanthanum, the efficiency of development is improved from about 50 percent to close to 100 percent, all other conditions of development remaining the same. Thus, by employing the carrier particles in accordance with this invention, the operating conditions such as the voltage differential, the exposure energy employed in forming the latent electrostatic image and the speed of development may all be varied in order to achieve optimum conditions and results.

The invention is further illustrated by the following examples:

EXAMPLE 1

An electrographic device as described in U.S. Pat. No. 4,473,029 is employed in this example. The device has two electrostatic probes one before the magentic brush development station and one after the station to measure the voltage on the photoconductive film before and after development. The carrier particles are a lanthanum-strontium ferrite, the lanthanum being present in an amount of 2.7 percent by weight. The toner employed is described in Example 1 of U.S. Pat. No. 4,394,430, is present in a concentration of 13% based on the combined weight of the carrier and toner and charges to a value of 25 $\mu$C/g. The photoconductive film is charged to −370 volts and the magnetic brush is maintained at −150 volts. After development, the charge on the photoconductive film in developed areas is −150 volts thus indicating a development efficiency of $$100\% \left( \frac{220}{220} \times 100 = 100\% \right).$$

EXAMPLE 2

(Comparison)

Example 1 is repeated with the exception that $SrFe_{12}O_{19}$ is employed as the carrier material. The photoconductive surface is charged to 475 volts in order to achieve the same $D_{max}$ as that of Example 1. All other conditions including the toner concentration and charge are the same. The voltage on the photoconductive film surface after development is 275 volts. The development efficiency is $$\frac{475 - 275}{475 - 150} \times 100 = 61.5\%.$$

EXAMPLES 3–7

Strontium ferrite carrier particles containing lanthanum in the amounts set forth in the following table are prepared in accordance with the procedure set forth above. A device employing a developer station as described in U.S. Pat. No. 4,473,029 and a Buchner funnel disposed over the magnetic brush such that the filter paper is in the same relative position as the photoreceptor is used to determine throw-off developer during rotation of the brush. In each case, the same toner in the same concentration as set forth in Example 1 is used. The brush is rotated for each carrier for two minutes while vacuum is drawn and developer is collected on the filter paper. The data establishes that while the charge on the toner in each case is substantially the same, the throw-off is significantly higher when the limits of this invention are exceeded.

TABLE

| Example | Wt. % Lanthanum | Charge on the Toner μC/g | Throw-off mg |
|---|---|---|---|
| 3 | 3.3 | 25.5 | 1.0 |
| 4 | 7.9 | 27.1 | 13.6 |
| 5 | 2.7 | 32.3 | 0.2 |
| 6 | 4.9 | 35.5 | 0.1 |
| 7 | 8.2 | 26.1 | 11.0 |

Barium ferrite and lead containing ferrites commonly referred to as magnetoplumbite substituted with lanthanum achieve similar results when used as electrographic carrier materials.

Although the invention has been described in considerable detail, with particular reference to preferred embodiments, variations and modifications be made therein within the scope of the invention.

What is claimed is:

1. Carrier particles for use in the development of electrostatic latent images which comprise hard magnetic ferrite material having a single phase hexagonal crystal structure, exhibiting a coercivity of at least 300 Oersteds when magnetically saturated, and an induced magnetic moment of at least 20 EMU/gm of carrier in an applied field of 1000 Oersteds and containing from about 1 to about 5 percent by weight of lanthanum, where said particles are coated with a discontinuous resin layer.

2. The carrier particles of claim 1 wherein the hard magnetic ferrite material is strontium ferrite, barium ferrite or lead ferrite containing from about 1 to about 5 percent by weight of lanthanum.

3. The carrier particles of claim 2 wherein the hard magnetic ferrite is strontium ferrite.

4. The carrier particles of claim 2 wherein the hard magnetic ferrite is barium ferrite.

5. The carrier particles of claim 1 wherein the hard magnetic ferrite is lead ferrite.

6. The carrier particles of claim 1 having the formula $La_xM_{1-x}Fe_{12}O_{19}$ where x has a value such that lanthanum is present in an amount of about 1 to about 5 percent by weight and M is Ba, Sr or Pb.

7. The composition of claim 1 wherein x has a value such that lanthanum is present in an amount of from about 2 to 4.5 percent by weight.

8. A method for developing an electrostatic image comprising contacting the image with a two-component dry developer composition comprising charged toner particles and oppositely charged carrier particles according to claim 1.

9. An electrostatic two-component dry developer composition for use in the development of electrostatic latent images which comprises a mixture of charged toner particles and oppositely charged carrier particles which comprise hard magnetic ferrite material having a single phase hexagonal crystal structure, exhibiting a coercivity of at least 300 Oersteds when magnetically saturated, and an induced magnetic moment of at least 20 EMU/gm of carrier in an applied filed of 1000 Oersteds and containing from about 1 to about 5 percent by weight of lanthanum.

10. The composition of claim 9 wherein the hard magnetic ferrite material is strontium ferrite, barium ferrite or lead ferrite containing from about 1 to about 5 percent by weight of lanthanum.

11. The composition of claim 10 wherein the hard magnetic ferrite is strontium ferrite.

12. The composition of claim 10 wherein the hard magnetic ferrite is barium ferrite.

13. The composition of claim 10 wherein the hard magnetic ferrite is lead ferrite.

14. The composition of claim 9 wherein said carrier particles have the formula $La_xM_{1-x}Fe_{12}O_{19}$ where x has a value such that lanthanum is present in an amount of about 1 to about 5 percent by weight and M is Ba, Sr or Pb.

15. The composition of claim 9 wherein lanthanum is present in an amount of from about 2 to 4.5 percent by weight.

16. A method for developing an electrostatic image comprising contacting the image with a two-component dry developer composition according to claim 9.

17. An electrostatic single-component dry developer for use in the development of electrostatic latent images which comprises a composite of a binder and a hard magnetic ferrite material having a single phase hexagonal crystal structure, exhibiting a coercivity of least 300 Oersteds when magnetically saturated, and an induced magnetic moment of at least 20 EMU/gm of carrier in an applied field of 1000 Oersteds and containing from about 1 to about 5 percent by weight of lanthanum.

18. The developer of claim 17 wherein the hard magnetic ferrite material is strontium ferrite, barium ferrite or lead ferrite containing from about 1 to about 5 percent by weight of lanthanum.

19. The developer of claim 18 wherein the hard magnetic ferrite is strontium ferrite.

20. The developer of claim 18 wherein the hard magnetic ferrite is barium ferrite.

21. The developer of claim 18 wherein the hard magnetic ferrite is lead ferrite.

22. The developer of claim 17 wherein said carrier particles have the formula $La_xM_{1-x}Fe_{12}O_{19}$ where x has a value such that lanthanum is present in an amount of about 1 to about 5 percent by weight and M is Ba, Sr or Pb.

23. The developer of claim 17 wherein lanthanum is present in an amount of from about 2 to 4.5 percent by weight.

24. A method for developing an electrostatic image comprising contacting the image with a single-component dry developer according to claim 17.

* * * * *